US008642249B2

(12) United States Patent
Anderson et al.

(10) Patent No.: US 8,642,249 B2
(45) Date of Patent: Feb. 4, 2014

(54) MICRO-FLUID EJECTION DEVICES WITH A POLYMERIC LAYER HAVING AN EMBEDDED CONDUCTIVE MATERIAL

(75) Inventors: Frank E Anderson, Sadieville, KY (US); Yimin Guan, Lexington, KY (US); Carl Edmond Sullivan, Stamping Ground, KY (US); Timothy Lowell Strunk, Georgetown, KY (US)

(73) Assignee: Funai Electric Co., Ltd., Osaka (JP)

( * ) Notice: Subject to any disclaimer, the term of this patent is extended or adjusted under 35 U.S.C. 154(b) by 639 days.

(21) Appl. No.: 12/842,329

(22) Filed: Jul. 23, 2010

(65) Prior Publication Data

US 2010/0285411 A1 Nov. 11, 2010

Related U.S. Application Data

(62) Division of application No. 11/426,647, filed on Jun. 27, 2006, now abandoned.

(51) Int. Cl.
*B41J 2/16* (2006.01)

(52) U.S. Cl.
USPC ..... 430/320; 430/315; 430/319; 29/890.1

(58) Field of Classification Search
None
See application file for complete search history.

(56) References Cited

U.S. PATENT DOCUMENTS 6,663,221 B2 * 12/2003 Anagnostopoulos et al. .. 347/40

* cited by examiner

*Primary Examiner* — John A. McPherson
(74) *Attorney, Agent, or Firm* — Amster, Rothstein & Ebenstein LLP

(57) ABSTRACT

Micro-fluid ejection devices, methods for making a micro-fluid ejection device, and methods for reducing a size of a substrate for a micro-fluid ejection head. One such micro-fluid ejection device has a polymeric layer adjacent a substrate and at least one conductive layer embedded in the polymeric layer. The polymeric layer comprises at least two layers of polymeric material.

16 Claims, 3 Drawing Sheets

MICRO-FLUID EJECTION DEVICES WITH A POLYMERIC LAYER HAVING AN EMBEDDED CONDUCTIVE MATERIAL

This application claims priority and benefit as a divisional application of U.S. patent application Ser. No. 11/426,647, having the same name, filed Jun. 27, 2006 now abandoned.

TECHNICAL FIELD

The present disclosure is generally directed toward micro-fluid ejection devices and methods for making micro-fluid ejection devices containing embedded electrical components. More particularly, in an exemplary embodiment, the disclosure relates to methods and apparatus that enable a reduction in substrate size for micro-fluid ejection devices.

BACKGROUND AND SUMMARY

Conventional micro-fluid ejection heads, for example, ink jet printheads, have electrical wiring exclusively located on a flexible circuit electrically connected to a substrate or on the substrate itself. In such conventional micro-fluid ejection heads, the substrate contains ejection devices, for example, resistors and piezoelectric device, drivers for the ejection devices, and conductors providing connection between the drivers and the ejection devices. Contact pads are also provided on the substrate to provide electrical communication with a control source, for example, an ink jet printer.

As micro-fluid ejection heads become more complex and include more functionality, the size of the substrate must often be increased to accommodate additional electrical components and/or contact pads and conductive paths required for the electrical components. Also, conductive pathways on the substrate become more complicated as the number of electrical components increases. At the same time, there is a need to increase the number of ejection devices on the substrate and reduce the size of the substrate in order to provide increased operational speed in closer droplet spacing. Accordingly, there continues to be a need for improved micro-fluid ejection heads and construction techniques that enable substrate size reduction and/or increased functionality for a given substrate size.

With regard to the foregoing and other needs, exemplary embodiments of the disclosure provide, for example, a micro-fluid ejection device having a polymeric layer adjacent a substrate, and at least one conductive layer embedded in the polymeric layer. The polymeric layer may be made of at least two layers of polymeric material.

In another aspect, the disclosure provides a method for making a micro-fluid ejection head. According to one such method, a first polymeric material for a polymeric layer is deposited adjacent a substrate. The first polymeric material is imaged and developed. Next a conductive material is deposited adjacent at least a portion of the first polymeric material to provide a conductive path for electrical communication with an electrical signal source. At least a second polymeric material for the polymeric layer is deposited adjacent the first polymeric material and conductive material to provide the conductive path embedded in the polymeric layer.

In yet a further aspect, the disclosure provides a method for reducing a size of a substrate for a micro-fluid ejection head. According to one such method, a first polymeric material for a polymeric layer is deposited adjacent a substrate. The first polymeric material is imaged and developed. An electrical component selected from the group consisting of electrical traces, capacitors, anti-fuse devices, and the like is deposited adjacent the first polymeric material. At least a second polymeric material for the polymeric layer is deposited adjacent the first polymeric material and electrical component to provide the electrical component embedded in the polymeric layer.

An advantage of exemplary methods and apparatus described herein includes that electrical components, such as conductive traces, anti-fuse devices, and capacitors, which traditionally are provided on a substrate, may be provided as an embedded component in multiple polymeric layers adjacent the substrate. When the substrate contains a fluid flow slot therethrough, electrical tracing may cross-over the slot in the polymeric layer rather than being routed around the slot.

BRIEF DESCRIPTION OF THE DRAWINGS

Further advantages of exemplary embodiments disclosed herein may become apparent by reference to the detailed description of exemplary embodiments when considered in conjunction with the drawings, which are not to scale, wherein like reference characters designate like or similar elements throughout the several drawings as follows.

DETAILED DESCRIPTION OF EXEMPLARY EMBODIMENTS

As set forth above, exemplary embodiments of the disclosure relate to apparatus and methods that may enable reduction in substrate size, an increase in ejector density on a substrate, and/or an increase in ejectors on a substrate without increasing substrate size. An exemplary embodiment of the apparatus and methods described herein includes a conductive component in a polymeric layer rather than requiring it to be on a substrate.

Figure 1:
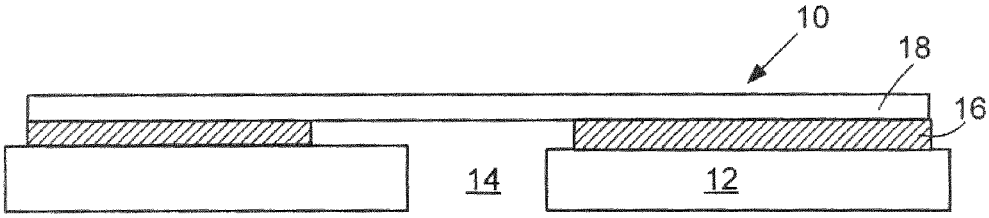
FIG. 1 PRIOR ART
FIG. 1 is a cross-sectional view, not to scale, of a prior art micro-fluid ejection head structure.
Figure 2:
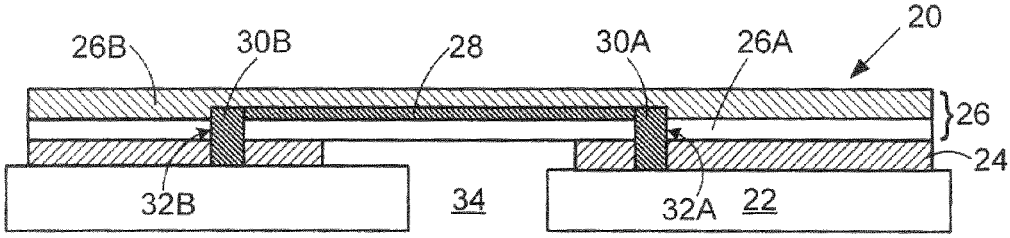
FIG. 2 is a cross-sectional view, not to scale, of a micro-fluid ejection head structure including an embedded conductor in a polymeric layer thereof.

A comparison between FIGS. 1 and 2 may illustrate one aspect of the disclosed embodiments. FIG. 1 is a conventional micro-fluid ejection head 10 having a substrate 12 with a fluid flow slot 14 etched therethrough. The slot 14 is typically an elongate slot with fluid ejection actuators disposed on one or both sides thereof. A thick film layer 16, such as one having fluid chambers and/or fluid flow channels is adjacent the substrate 12. A polymeric layer, such as one comprising nozzle plate 18, is adjacent the thick film layer 14. In other prior art ejection heads, a nozzle plate might contain the fluid chambers and fluid flow channels and is directly adjacent the substrate 12 without an intervening thick film layer 16.

All of the conductive traces, ejection actuators, drivers, and the like, are deposited on the substrate 12. Hence, sufficient substrate area is needed to provide routing of conductive traces to the ejection actuators and other devices. Because of the slot 14, the conductive traces must go around the slot 14 to provide electrical continuity to components on both sides of the slot 14. However, routing conductive traces around the slot 14 may give rise to inequities in series resistance to the fluid ejection actuators as well as increasing the size of the substrate 12 for such conductive trace placement.

The substrate 12 is electrically connected to a flexible circuit (e.g., a TAB circuit), such as by using tab bond pads on the substrate 12. The flexible circuit can only provide connections to edges of the substrate 12 since a major portion of the substrate is covered by the nozzle plate 18. Accordingly, such edge connections require additional conductive traces and contact pad areas on the substrate 12 which tends to increase rather than decrease the size of the substrate 12.

By contrast, embodiments of the disclosure provide an improved micro-fluid ejection head structure 20 as illustrate in FIG. 2. In the embodiment illustrated in FIG. 2, a substrate 22 having a thick film layer 24 and a polymeric layer, such as one in the form of a nozzle plate 26, is provided. Thick film layer 24 and nozzle plate 26 are made of a polymeric material that is substantially non-conductive. Suitable polymeric materials include, epoxies, polyimides, polyamides, polyurethanes, polyesters and the like. A particularly suitable material for the thick film layer 24 is a photoresist material that can be imaged and developed to provide electrical contact holes therein.

The nozzle plate 26 is suitably a multi-layer nozzle plate. As shown in FIG. 2, the nozzle plate 26 includes a first nozzle plate layer 26A and a second nozzle plate layer 26B. Each layer 26A and 26B may have a thickness ranging from about 5 to about 15 microns or more providing an overall nozzle plate thickness ranging from about 10 to about 30 microns or more. For convenience, the layer 24 having fluid chambers and fluid flow channels is referred to as "the thick film layer" and the layer having nozzles is referred to as "the nozzle plate layer."

A conductive path 28 may be embedded in the nozzle plate 26 between layers 26A and 26B. Electrical contacts 30A and 30B with the substrate 22 are provided by contact holes 32A and 32B in the first nozzle plate layer 26A and in the thick film layer 24. The conductive path 28 may have a thickness ranging from about 1000 Angstroms to about 10 microns, for example.

As illustrated in FIG. 2, the conductive path 28 may cross over a fluid flow slot 34 in the substrate 22. Since the conductive path 28 is embedded in the nozzle plate 26 and may be routed between nozzles in the nozzle plate 26, the conductive path 28 is protected from exposure to fluids ejected by the micro-fluid ejection head. Multiple conductive paths may be routed in the nozzle plate 26, such as to reduce an area requirement on the substrate 22 for such conductive materials.

Figure 3:
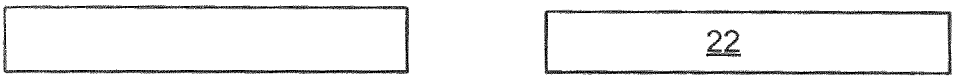
FIGS. 3-7 are schematic cross-sectional views, not to scale, of a method for making a micro-fluid ejection head structure according to an exemplary embodiment of the disclosure.
Figure 4:
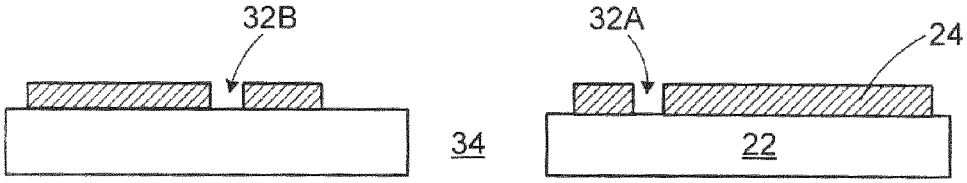

FIGS. 3-7 illustrate process steps which may be used to provide the improved micro-fluid ejection head 20 of FIG. 2. As shown in FIG. 3, the substrate 22 is provided and etched to provide the fluid flow slot 34 therethrough. The substrate 22 may be made from a wide variety of materials including, but not limited to, ceramics, silicon, glass, plastic, and other semiconductor materials. Prior to depositing the thick film layer 24 adjacent the substrate 22, the fluid ejection actuator, drivers, electrical contact pads, and conductive tracing are deposited or grown on the substrate 22, such as by conventional semiconductor processing steps.

Next, the thick film layer 24 may be deposited adjacent the substrate 22, such as by a spin-coating or lamination process. The thick film layer 24 may be imaged and developed to provide the contact holes 32A and 32B therein, and to provide the fluid chambers and fluid supply channels for fluid flow to fluid ejection actuators on the substrate 22. The thick film layer 24 may have a thickness ranging from about 5 to about 50 microns, for example.

Figure 5:
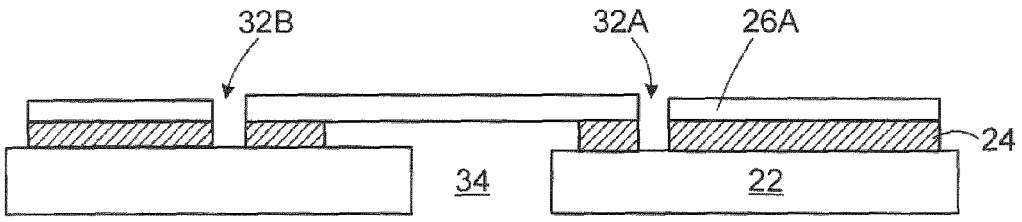
Figure 6:
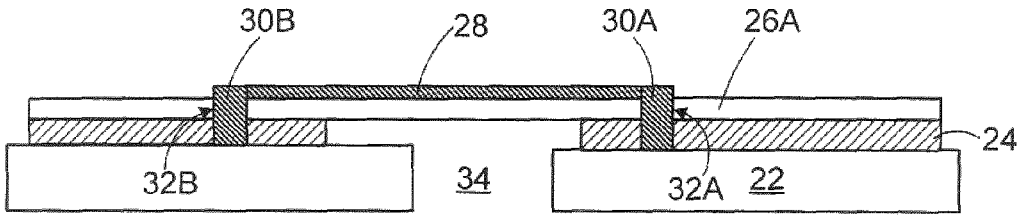

As shown in FIG. 5, the first nozzle plate layer 26A may be deposited adjacent the thick film layer 24 or laminated onto the thick film layer 24 to provide a portion of the nozzle plate 26. As with the thick film layer 24, the first nozzle plate layer 26A may be imaged and developed to provide the contact holes 32A and 32B therethrough.

Next, a conductive material may be applied to at least a portion of the first nozzle plate layer 26A and in the contact holes 32A-32B to provide the conductive path 28 and contacts 30A and 30B. The conductive material providing the conductive path 28, and contacts 30A and 30B, may be applied to the nozzle plate layer 26A, such as by a wide variety of techniques including, but not limited to, fluid jet printing, low temperature sputtering, electrolytic plating, and the like. Accordingly, the conductive material may be composed of copper, aluminum, silver, nickel, gold, and alloys thereof. A particularly suitable conductive material is copper that is applied by a copper plating technique.

By way of example, a copper plating technique for depositing conductive materials on a polymeric layer will now be described. Prior to plating copper onto the first nozzle plate layer 26A, electroless copper deposits are applied to the nozzle plate layer 26A to provide a conductive base for subsequent plating. Such electroless copper deposits typically have a thickness ranging from about 1.0 to about 2.0 microns followed by an additional decorative or protective thickness of copper, nickel, or gold deposited electrolytically or electrolessly. The electroless copper in such applications provides good life in corrosive atmospheric and/or environmental exposures. Likewise, electroless copper may be used to provide excellent electrical conductivity in the contact holes 30A and 30B. Prior to depositing the electroless copper, the first nozzle plate layer 26A may be pretreated by immersing the first nozzle plate layer 26A in an acidic aqueous solution of stannous chloride ($SnCl_2$) and palladium chloride ($PdCl_2$). Many other activators may be used to pretreat the first nozzle plate layer 26A before electroless copper deposition thereon.

The pH of an electroless copper bath used for plating will influence the brightness of the copper deposits. Usually a pH value above about 12.0 is suitable. A dark deposit may indicate low bath alkalinity and contain cuprous oxide. The plating rate is also influenced by the pH. In formaldehyde-reduced baths a pH value of 12.0-13.0 is generally best. Stability of the bath and pH are critical to providing suitable copper deposits. A high pH value (14.0) results in poor solution stability and reduces the bath life. Below a pH of 9.5, solution stability is good; however, deposition slows or ceases.

During the deposition process, the principal components of the electroless copper bath (copper, formaldehyde, and caustic) must be kept within predetermined limits through replenishment. Other bath chemical components may remain within recommended ranges. Complexing agents and stabilizer levels occasionally need independent control. Other key operating parameters include temperature, air agitation, filtration, and circulation.

Various common reducing agents have been suggested, however, the best known reducing agent for electroless copper baths is formaldehyde. A complexing agent (i.e. Rochelle salt) serves to complex the copper ion to prevent solution precipitation and has an effect on deposition rates as well as the quality of the deposits. A stable electroless plating bath has a plating rate of about 1 to about 5 microns per hour and operates in an alkaline solution having a pH ranging from about 10.0 to about 13.0.

An example of a formaldehyde-reduced electroless copper bath is provided in Table 1.

TABLE I

| Formaldehyde-Reduced Electroless Copper Bath | |
|---|---|
| Bath Component | |
| Copper salt as $Cu^2$ | 1.0 grams/liter |
| Rochelle salt | 25 grams/liter |
| Formaldehyde as HCHO | 10 grams/liter |
| Sodium hydroxide | 5.0 grams/liter |
| 2-mercaptobensothizole | <2 grams/liter |
| pH | 12 |
| Temperature | 25° C. |

Recent formulations allow for alkanol amines such as N,N,N',N'-tetrakis(2-hydroxypropyl)ethylenediamine-reduced baths. Such baths having high build rates (>10 um/hr) or heavy deposition baths operate at a lower pH without the use of formaldehyde. High build baths generally are more expensive and exhibit less stability but do not have harmful formaldehyde vapors given off during subsequent solution make up, heating, and deposition. Such baths may deposit enough low stress copper to eliminate the need for an electrolytic flash.

TABLE II

| Dimethylamine Borane-Reduced Electroless Nickel Bath | |
|---|---|
| Bath Component | |
| Nickel sulfate | 25 grams/liter |
| Sodium acetate | 15 grams/liter |
| n-dimethylamine borane | 4 grams/liter |
| Lead acetate | 0.002 grams/liter |
| pH | 5.9 |
| Temperature | 26° C. |

Figure 7:
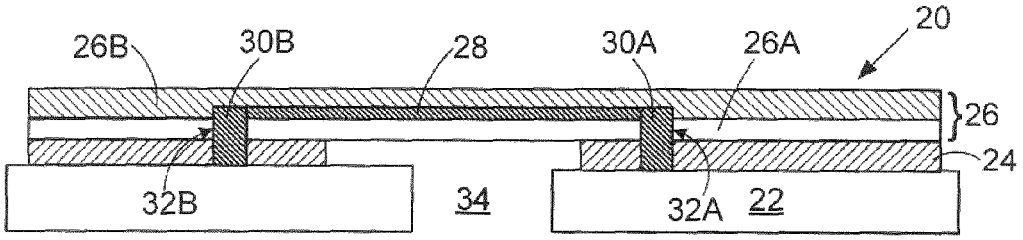

Subsequent to depositing the conductive material onto the first nozzle plate layer 26A, the second nozzle plate layer 26B may be applied to the conductive path 28 and first nozzle plate layer 26A. As shown in FIG. 7, the resulting micro-fluid ejection head 20 has an embedded conductive path 28, such as one that is protected from fluid contact and may cross-over the fluid slot 34 without interfering with the slot 34.

Figure 8A:
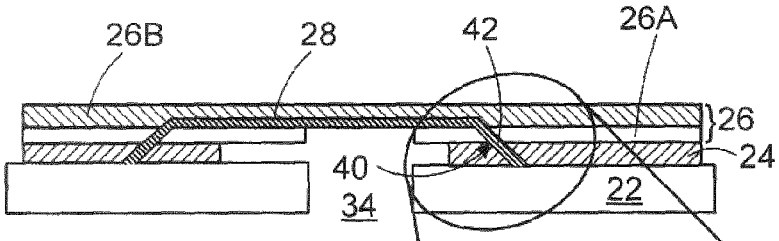
FIGS. 8A-8B are cross-sectional views, not to scale, illustrating a sloping conductor via through a polymeric layer according to an alternate embodiment of the disclosure.
Figure 8B:
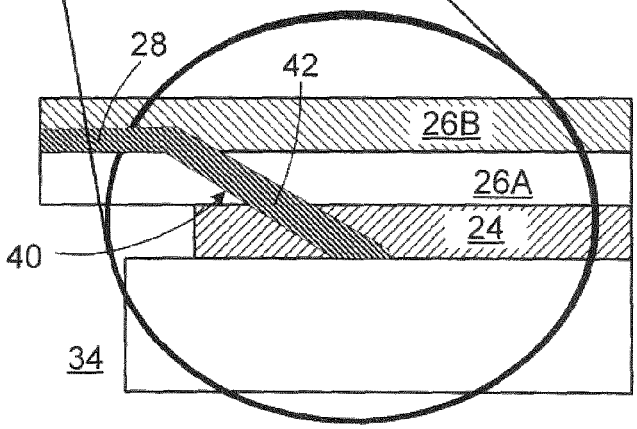

In the foregoing illustrations, the contact holes 32A and 32B and contacts 30A and 30B were shown for convenience as substantially vertical holes 32A-32B and contacts 30A-30B. However, as illustrated in FIGS. 8A and 8B, sloped contact holes, such as contact hole 40, for example, may be used to ease step coverage of the conductive material providing a contact 42. Accordingly, the foregoing embodiments also contemplate such sloped contact holes 40 and contacts 42.

Figure 9:
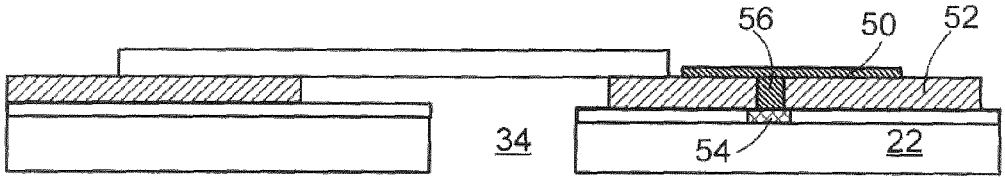
FIG. 9 is a cross-sectional view of a contact pad on a polymeric layer according to another embodiment of the disclosure.
Figure 10:
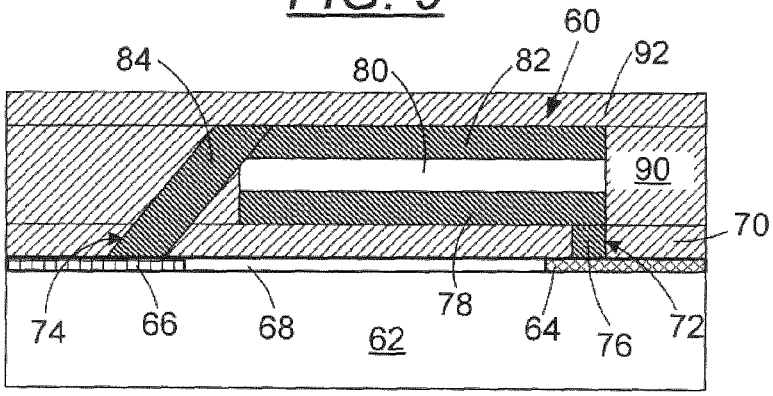
FIG. 10 is a cross-sectional view, not to scale of a capacitor device embedded in a polymeric layer according to yet another embodiment of the disclosure.

Other embodiments of the disclosure are illustrated in FIGS. 9 and 10. In FIG. 9, a relatively large contact pad 50 is provided on a thick film layer 52 rather than on the substrate 22. The contact pad 50 is electrically connected to a smaller contact pad 54 on the substrate by conductive contact 56. Methods for providing the contact pad 50 and contact 56 are described above with reference to FIGS. 3-8.

Yet another embodiment of the disclosure provides a conductive component that is embedded in a polymeric layer of a micro-fluid ejection head. For example, capacitors tend to take up a large amount of substrate area and have a higher fallout due to point defects and particle damage during substrate fabrication. One way to eliminate such defects is to move the capacitors from the substrate and into a control device remote from the substrate. However, moving the capacitors to the control device increases the cost of the control device.

Using the techniques described above, a capacitor may be embedded in the polymeric layer(s) of a nozzle plate and/or thick film layer of a micro-fluid ejection head, for example. FIG. 10 illustrates a capacitor 60 that may be embedded in a polymeric layer. As shown in FIG. 10, a substrate 62 having a first conductor 64 and a second conductor 66 with an insulating layer 68 between the first and second conductors 64 and 66 is provided. A thick film layer 70 may be applied adjacent the substrate 62 and conductors 64 and 66, and imaged and developed to provide contact holes 72 and 74 therein, such as described above. A conductive material may be applied to the thick film layer to provide an electrical contact 76 to the first conductor 64 and a first electrode 78. A dielectric layer 80 may be deposited adjacent the first electrode 78 and a second electrode 82 deposited adjacent the dielectric layer 80. Conductive material may be deposited in the contact hole 74 to provide contact 84 for electrical connection between the second electrode 82 and the second conductor 66.

A first nozzle plate layer 90 may be deposited adjacent the thick film layer 70, and imaged and developed to provide a location for the capacitor 60. Once the capacitor 60 is formed, a second nozzle plate layer 92 may be deposited adjacent the first nozzle plate layer 90 to provide the embedded capacitor. It will be appreciated that other conductive devices, including, but not limited to anti-fuse devices, and fuses may also be embedded in polymeric layers of the micro-fluid ejection head using the techniques described herein.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

The invention claimed is:

1. A method for making a micro-fluid ejection head comprising:

depositing a first polymeric material for a polymeric layer adjacent a substrate;

imaging and developing the first polymeric material to form a fluid flow channel in the first polymeric material;

depositing a conductive material adjacent at least a portion of the first polymeric material to provide a conductive path for electrical communication with an electrical signal source, the conductive path crossing over the fluid flow channel in the first polymeric material; and depositing at least a second polymeric material for the polymeric layer adjacent the first polymeric material and conductive material to provide the conductive path embedded in the polymeric layer.

2. The method of claim 1, wherein depositing a first polymeric material comprises depositing a photoresist material.

3. The method of claim 2, wherein depositing at least a second polymeric material comprises depositing a polyimide material.

4. The method of claim 1, wherein the conductive material is deposited by a process selected from the group consisting of electroplating, film etching, low temperature sputtering, and printing.

5. The method of claim 1, wherein the polymeric layer comprises a nozzle plate comprising at least two nozzle plate layers.

6. The method of claim 1, wherein the polymeric layer comprises a thick film layer and a nozzle plate.

7. The method of claim 1, wherein depositing a conductive material comprises depositing a material selected from the group consisting of copper, gold, aluminum, and silver.

8. The method of claim 1, wherein the substrate comprises a fluid flow slot therethrough and wherein the conductive path provided crosses over the fluid flow slot.

9. A method for making a micro-fluid ejection head comprising:

forming a fluid flow slot in a substrate;

forming a first polymeric material for a polymeric layer adjacent the substrate;

imaging and developing the first polymeric material;

forming a conductive material adjacent at least a portion of the first polymeric material and over the fluid flow slot from one side to another side to provide a conductive path that spans across the slot for electrical communication with an electrical signal source on both sides of the slot; and depositing at least a second polymeric material for the polymeric layer adjacent the first polymeric material and conductive material to provide the conductive path embedded in the polymeric layer.

10. The method of claim 9, further including forming electrical contacts on said substrate one each on said one side and another side of the fluid flow slot to electrically communicate the conductive material to the substrate.

11. The method of claim 9, wherein the forming the conductive material further includes depositing electroless copper on the first polymeric material to provide a conductive base for subsequent plating.

12. The method of claim 11, wherein the subsequent plating further includes electrolytically or electrolessly depositing copper, nickel or gold.

13. The method of claim 11, wherein prior to the depositing the electroless copper, the first polymeric material is pretreated by immersing the first polymeric material in a bath of acidic aqueous solution.

14. The method of claim 13, wherein the pretreating further includes providing the acidic aqueous solution as stannous chloride and palladium chloride.

15. The method of claim 13, wherein the pretreating further includes providing the bath with a pH value above 12.0 but below 14.0 or with a pH value below 9.5.

16. The method of claim 15, wherein the providing the bath further includes introducing a formaldehyde reduced bath to obtain said pH values.

* * * * *